US010598005B2

(12) United States Patent
Prince et al.

(10) Patent No.: US 10,598,005 B2
(45) Date of Patent: Mar. 24, 2020

(54) PH-SENSITIVE CHEMICALS FOR DOWNHOLE FLUID SENSING AND COMMUNICATION WITH THE SURFACE

(71) Applicant: Halliburton Energy Services, Inc., Houston, TX (US)

(72) Inventors: Aaron Prince, Houston, TX (US); Krishna M. Ravi, Kingwood, TX (US); John P. Singh, Kingwood, TX (US); Marcos Aurelio Jaramillo, Dickinson, TX (US); Walmy Cuello Jimenez, Houston, TX (US); Andy Chang, Houston, TX (US); Thomas Singh Sodhi, New Caney, TX (US); Xueyu Pang, Tomball, TX (US); Thomas Jason Pisklak, Cypress, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 0 days.

(21) Appl. No.: 16/081,602

(22) PCT Filed: Apr. 5, 2016

(86) PCT No.: PCT/US2016/025995

§ 371 (c)(1),
(2) Date: Aug. 31, 2018

(87) PCT Pub. No.: WO2017/176254

PCT Pub. Date: Oct. 12, 2017

(65) Prior Publication Data

US 2019/0024503 A1 Jan. 24, 2019

(51) Int. Cl.

| | |
|---|---|
| ***E21B 33/12*** | (2006.01) |
| ***E21B 47/12*** | (2012.01) |
| ***C09K 8/42*** | (2006.01) |
| ***E21B 37/06*** | (2006.01) |
| *E21B 43/25* | (2006.01) |

(52) U.S. Cl.
CPC ..... *E21B 47/12* (2013.01); *E21B 37/06* (2013.01); *E21B 43/25* (2013.01)

(58) Field of Classification Search
CPC ..... C09K 2208/08; C09K 8/426; E21B 37/06; E21B 43/16; E21B 43/25; E21B 43/26; E21B 43/267; E21B 43/28; E21B 47/12
See application file for complete search history.

(56) References Cited

U.S. PATENT DOCUMENTS

2011/0214881 A1 9/2011 Newton et al.
2013/0043022 A1 2/2013 Forster
(Continued)

FOREIGN PATENT DOCUMENTS

EP 0015726 9/1980

OTHER PUBLICATIONS

International Search Report and Written Opinion of PCT Application No. PCT/US2016/025995 dated Dec. 8, 2016: pp. 1-15.
(Continued)

*Primary Examiner* — Zakiya W Bates
(74) *Attorney, Agent, or Firm* — Chamberlain Hrdlicka

(57) ABSTRACT

A method and system for treating a subterranean formation involves detecting the displacement and position of a downhole fluid having a pH through the fluids reaction with a pH-sensitive material, mobilizing a plug assembly comprising the material to contact one or more constrictions in a wellbore casing.

14 Claims, 4 Drawing Sheets

(56) References Cited

U.S. PATENT DOCUMENTS

| | | | |
|---|---|---|---|
| 2013/0105159 | A1 | 5/2013 | Alvarez et al. |
| 2015/0167424 | A1 | 6/2015 | Richards et al. |
| 2015/0345255 | A1 | 12/2015 | Onuoha |

OTHER PUBLICATIONS

Smith et al., SPE 38523: "Deepwater Remotely Actuated Completions for the 21st Century," Society of Petroleum Engineers, 1997: pp. 421-436.

Smith et al., OTC 8844: "Deepwater Remotely Actuated Completions for the 21st Century," Offshore Technology Conference, 1998: pp. 473-487.

Tsuji, "Chapter 21: Hydrolytic Degradation," Poly(Lactic Acid): Synthesis, Structures, Properties, Processing, and Applications, Auras et al. eds., John Wiley & Sons, Inc., New Jersey, 2010: pp. 345-382.

PH-SENSITIVE CHEMICALS FOR DOWNHOLE FLUID SENSING AND COMMUNICATION WITH THE SURFACE

BACKGROUND OF THE INVENTION

Various downhole applications benefit from or rely upon the detection of the presence of a particular material, such as a fluid, in a wellbore. Based upon such detection, surface operators are then able to take further actions, such as introducing a new fluid, ceasing injection of a fluid, and the like. Downhole detection techniques typically call for specialized telemetry such as electromagnetic pulses and fiber optics for communication with surface operators. In addition, operators can employ tracers to detect particular fluids, volumes, and flow rates. Hence, while accurate downhole fluid detection is important, especially for offshore operations, existing techniques such as those described above add complexity and equipment demands.

BRIEF DESCRIPTION OF THE FIGURES

In the drawings, which are not necessarily drawn to scale, like numerals describe substantially similar components throughout the several views. Like numerals having different letter suffixes represent different instances of substantially similar components. The drawings illustrate generally, by way of example, but not by way of limitation, various embodiments discussed in the present document.

Figure 1:
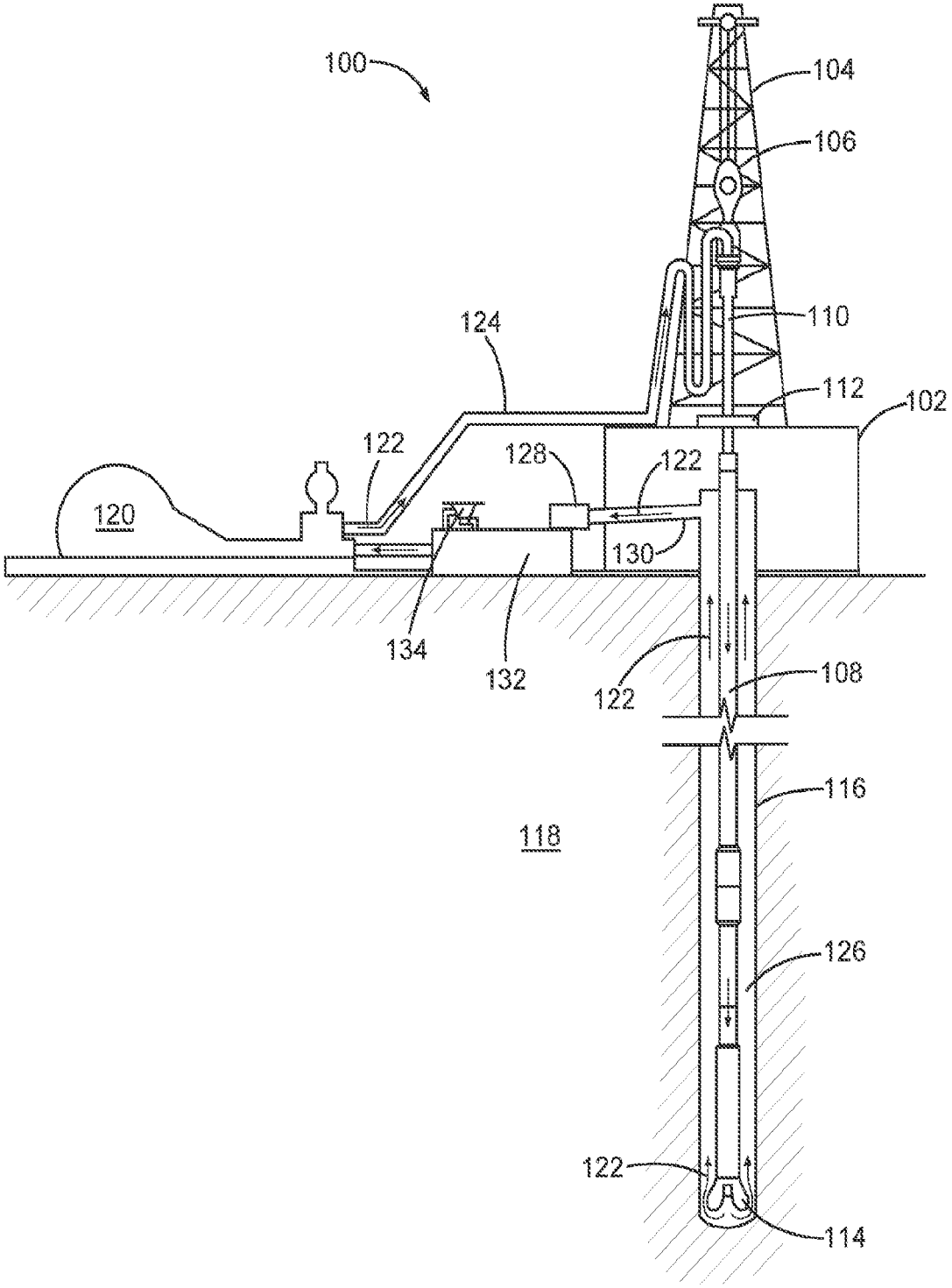
FIG. 1 illustrates a drilling assembly in accordance with various embodiments.

FIG.'s 3A-3D illustrate a system for treating a subterranean formation in according with various embodiments.

FIG.'s 4A-4D illustrate another system for treating a subterranean formation in according with various embodiments.

DETAILED DESCRIPTION OF THE INVENTION

Following is a description of certain embodiments of the disclosed subject matter, examples of which are illustrated in part by the accompanying drawings. While the disclosed subject matter is described in conjunction with the enumerated claims, it will be understood that the exemplified subject matter is not intended to limit the claims to the disclosed subject matter.

Definitions

Values expressed in a range format should be interpreted in a flexible manner to include not only the numerical values explicitly recited as the limits of the range, but also to include all the individual numerical values or sub-ranges encompassed within that range as if each numerical value and sub-range were explicitly recited. For example, a range of "about 0.1% to about 5%" or "about 0.1% to 5%" should be interpreted to include not just about 0.1% to about 5%, but also the individual values (e.g., 1%, 2%, 3%, and 4%) and the sub-ranges (e.g., 0.1% to 0.5%, 1.1% to 2.2%, 3.3% to 4.4%) within the indicated range. The statement "about X to Y" has the same meaning as "about X to about Y," unless indicated otherwise. Likewise, the statement "about X, Y, or about Z" has the same meaning as "about X, about Y, or about Z," unless indicated otherwise.

In this document, the terms "a," "an," or "the" are used to include one or more than one unless the context clearly dictates otherwise. The term "or" is used to refer to a nonexclusive "or" unless otherwise indicated. In addition, the phraseology or terminology employed herein, and not otherwise defined, is for the purpose of description only and not of limitation. Any use of section headings is intended to aid reading of the document and is not to be interpreted as limiting: information that is relevant to a section heading may occur within or outside of that particular section. Further, all publications, patents, and patent documents referred to in this document are incorporated by reference herein in their entirety, as though individually incorporated by reference. In the event of inconsistent usages between this document and those documents so incorporated by reference, the usage in the incorporated reference should be considered supplementary to that of this document; for irreconcilable inconsistencies, the usage in this document controls.

In the methods described herein, the steps can be carried out in any order without departing from the principles of the invention, except when a temporal or operational sequence is explicitly recited. Furthermore, specified steps can be carried out concurrently unless explicit claim language recites that they be carried out separately. For example, a claimed step of doing X and a claimed step of doing Y can be conducted simultaneously within a single operation, and the resulting process will fall within the literal scope of the claimed process.

The term "about" as used herein can allow for a degree of variability in a value or range, for example, within 10%, within 5%, or within 1% of a stated value or of a stated limit of a range.

The term "substantially" as used herein refers to a majority of, or mostly, as in at least about 50%, 60%, 70%, 80%, 90%, 95%, 96%, 97%, 98%, 99%, 99.5%, 99.9%, 99.99%, or at least about 99.999% or more.

The term "downhole" as used herein refers to under the surface of the earth, such as a location within or fluidly connected to a wellbore.

As used herein, the term "fluid" refers to liquids and gels, unless otherwise indicated.

As used herein, the term "subterranean material" or "subterranean formation" refers to any material under the surface of the earth, including under the surface of the bottom of the ocean. For example, a subterranean material can be any section of a wellbore and any section of an underground formation in fluid contact with the wellbore, including any materials placed into the wellbore such as cement, drill shafts, liners, tubing, or screens. In some examples, a subterranean material is any below-ground area that can produce liquid or gaseous petroleum materials, water, or any section below-ground in fluid contact therewith.

As used herein, the term "drilling fluid" refers to fluids, slurries, or muds used in drilling operations downhole, such as the formation of a wellbore.

As used herein, the term "stimulation fluid" refers to fluids or slurries used downhole during stimulation activities of the well that can increase the production of a well, including perforation activities. In some examples, a stimulation fluid can include a fracturing fluid or an acidizing fluid.

As used herein, the term "clean-up fluid" refers to fluids or slurries used downhole during clean-up activities of the well, such as any treatment to remove material obstructing the flow of desired material from the subterranean formation. In one example, a clean-up fluid can be an acidification treatment to remove material formed by one or more perforation treatments. In another example, a clean-up fluid can be used to remove a filter cake.

As used herein, the term "fracturing fluid" refers to fluids or slurries used downhole during fracturing operations.

As used herein, the term "spotting fluid" refers to fluids or slurries used downhole during spotting operations and can be any fluid designed for localized treatment of a downhole region. In one example, a spotting fluid can include a lost circulation material for treatment of a specific section of a wellbore, such as to seal off fractures in a wellbore and prevent sag. In another example, a spotting fluid can include a water control material. In some examples, a spotting fluid can be designed to free a stuck piece of drilling or extraction equipment; can reduce torque and drag with drilling lubricants; prevent differential sticking; promote wellbore stability; and can help to control mud weight.

As used herein, the term "production fluid" refers to fluids or slurries used downhole during the production phase of a well. Production fluids can include downhole treatments designed to maintain or increase the production rate of a well, such as perforation treatments, clean-up treatments or remedial treatments.

As used herein, the term "completion fluid" refers to fluids or slurries used downhole during the completion phase of a well, including cementing compositions.

As used herein, the term "remedial treatment fluid" refers to fluids or slurries used downhole for remedial treatment of a well. Remedial treatments can include treatments designed to increase or maintain the production rate of a well, such as stimulation or clean-up treatments.

As used herein, the term "abandonment fluid" refers to fluids or slurries used downhole during or preceding the abandonment phase of a well.

As used herein, the term "acidizing fluid" or "acidic treatment fluids" refers to fluids or slurries used downhole during acidizing treatments downhole. Acidic treatment fluids can be used during or in preparation for any subterranean operation wherein a fluid may be used. Suitable subterranean operations may include, but are not limited to, acidizing treatments (e.g., matrix acidizing or fracture acidizing), wellbore clean-out treatments, and other operations where a treatment fluid of the present invention may be useful. In a matrix acidizing procedure, for example, an aqueous acidic treatment fluid (e.g., a treatment comprising one or more compounds conforming to formulae I and II, an aqueous base fluid, and spent acid) is introduced into a subterranean formation via a wellbore therein under pressure so that the acidic treatment fluid flows into the pore spaces of the formation and reacts with (e.g., dissolves) acid-soluble materials therein. As a result, the pore spaces of that portion of the formation are enlarged, and the permeability of the formation may increase. The flow of hydrocarbons from the formation therefore may be increased because of the increase in formation conductivity caused, among other factors, by dissolution of the formation material.

In fracture acidizing procedures, one or more fractures are produced in the formation(s) and an acidic treatment fluid is introduced into the fracture(s) to etch flow channels therein. Acidic treatment fluids also may be used to clean out wellbores to facilitate the flow of desirable hydrocarbons. Other acidic treatment fluids may be used in diversion processes and wellbore clean-out processes. For example, acidic treatment fluids can be useful in diverting the flow of fluids present within a subterranean formation (e.g., formation fluids and other treatment fluids) to other portions of a formation, for example, by invading higher permeability portions of a formation with a fluid that has high viscosity at low shear rates.

As used herein, the term "cementing fluid" refers to fluids or slurries used during cementing operations of a well. For example, a cementing fluid can include an aqueous mixture including at least one of cement and cement kiln dust. In another example, a cementing fluid can include a curable resinous material, such as a polymer, that is in an at least partially uncured state.

As used herein, the term "fluid control material" (e.g., a "water control material") refers to a solid or liquid material that, by virtue of its viscosification in the flowpaths producing a fluid (e.g., water) alters, reduces or blocks the flow rates of such fluids into the wellbore, such that hydrophobic material can more easily travel to the surface and such that hydrophilic material (including water) can less easily travel to the surface. For example, a fluid control material can be used to treat a well to cause a proportion of a fluid produced, which may include water, to decrease and to cause the proportion of hydrocarbons produced to increase, such as by selectively causing the material to form a viscous plug between water-producing subterranean formations and the wellbore, while still allowing hydrocarbon-producing formations to maintain output.

In some embodiments, the fluid control material mitigates (e.g., reduces, stops or diverts) the flow of fluids (e.g., treatment fluids and water) through a portion of a subterranean formation that is penetrated by the well such that the flow of the fluid into high-permeability portions of the formation is mitigated. For example, in an injection well, it may be desirable to seal off high-permeability portions of a subterranean formation that would otherwise accept most of an injected treatment fluid. By sealing off the high-permeability portions of the subterranean formation, the injected treatment fluid may thus penetrate less permeable portions of the subterranean formation. In other embodiments, the fluid control material helps mitigate the production of undesired fluids (e.g., water) from a well by at least sealing off one or more permeable portions of a treated subterranean formation.

As used herein, the term "packing fluid" refers to fluids or slurries that can be placed in the annular region of a well, between tubing and outer casing above a packer. In various examples, the packer fluid can provide hydrostatic pressure in order to lower differential pressure across a sealing element; lower differential pressure on the wellbore and casing to prevent collapse; and protect metals and elastomers from corrosion.

Method

The inventive method provides accurate and sensitive remote sensing of downhole fluid treatment of subterranean formations generally based upon the creation of downhole pressure spikes that alert surface operators when a job or further action can be stopped or commenced. As described above, the method does not rely upon any specialized telemetry such as EM, or fiber optics for communication with the surface, thereby reducing the operation cost as well as widening applications of the method. Further, the method is easily integrated with current floating equipment or other existing downhole valves. Because the method exploits the inherent properties of the fluids being detected, there is no need for a tracer. In some embodiments, such as reverse cementing and other operations where downhole fluid detection is critical, the method is ideal owing to its accuracy.

An embodiment of the method comprises the displacement of a fluid having a pH through a wellbore in a subterranean formation. The expression "having a pH" contemplates an aqueous or semi-aqueous fluid amenable to measurement for the determination of pH. The selection of a particular pH is not critical so long as the pH is chosen in conjunction with the pH-sensitive material as described more fully herein. Thus, the absence of a fluid having a pH, as contemplated by the inventive method, does not necessarily mean the absence of any aqueous or semi-aqueous fluid, but rather means the absence of a fluid having pH that selectively reacts with the pH-sensitive material.

Figure 3C:
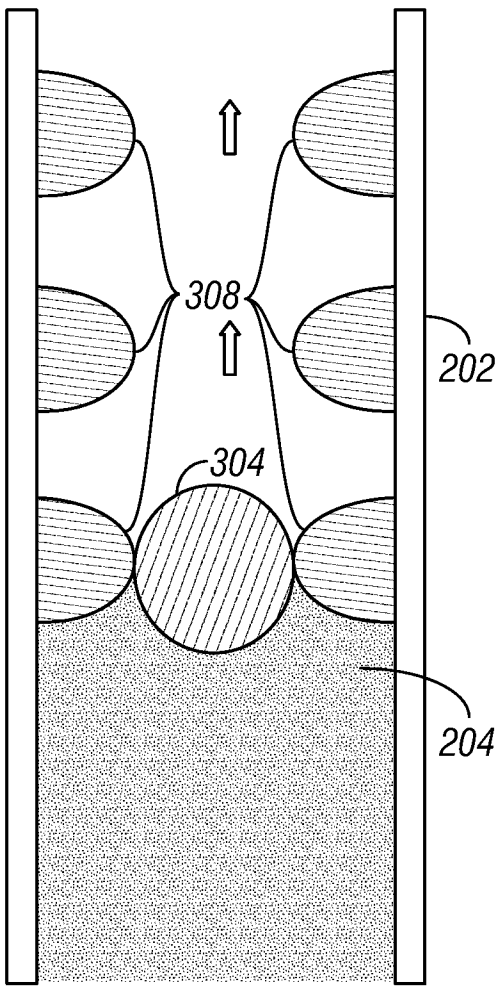
Figure 3B:
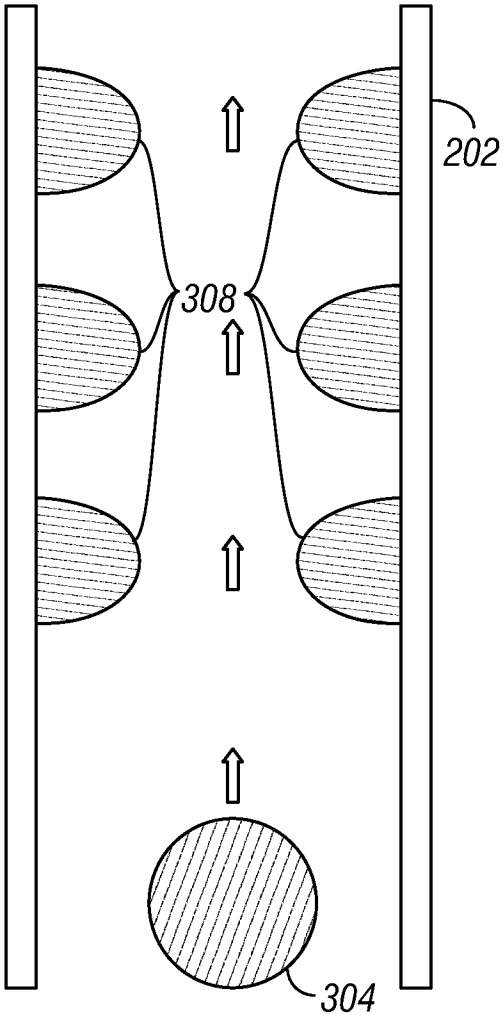
Figure 3A:
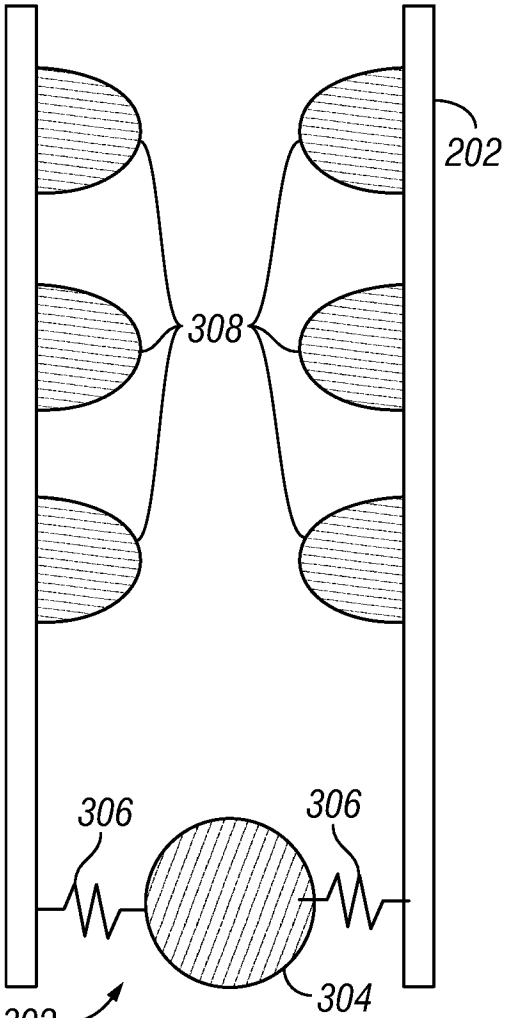
Figure 4D:
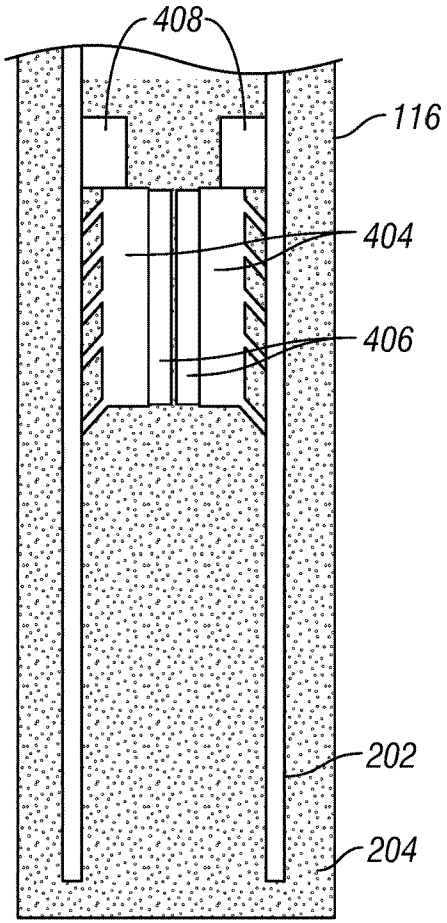
Figure 4C:
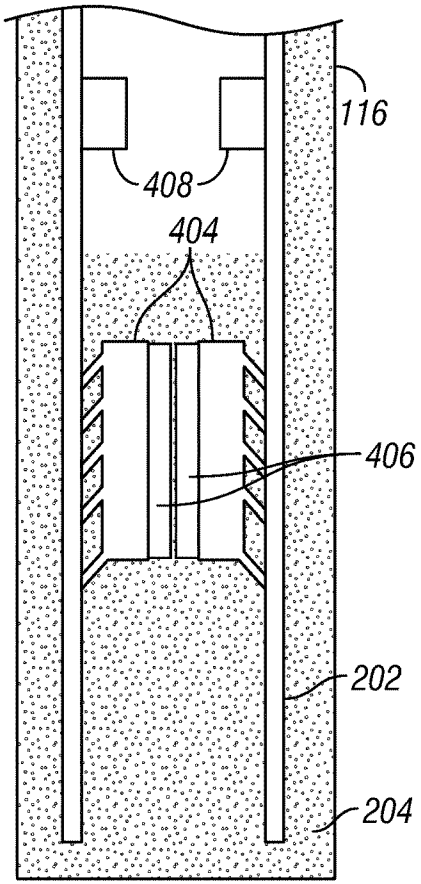
Figure 4B:
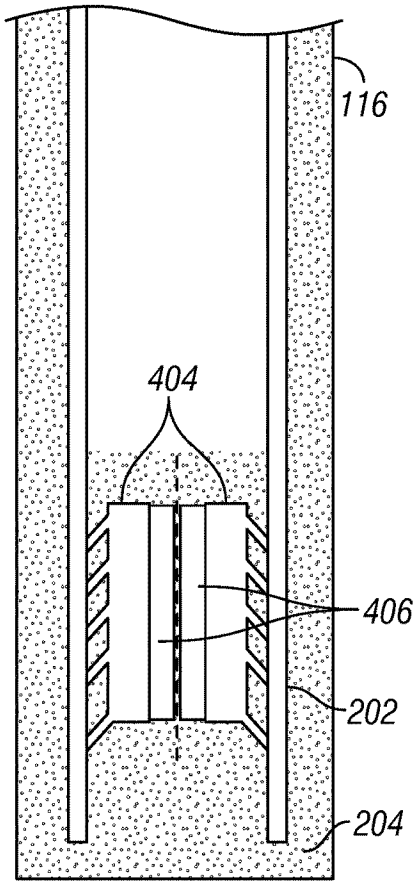
Figure 4A:
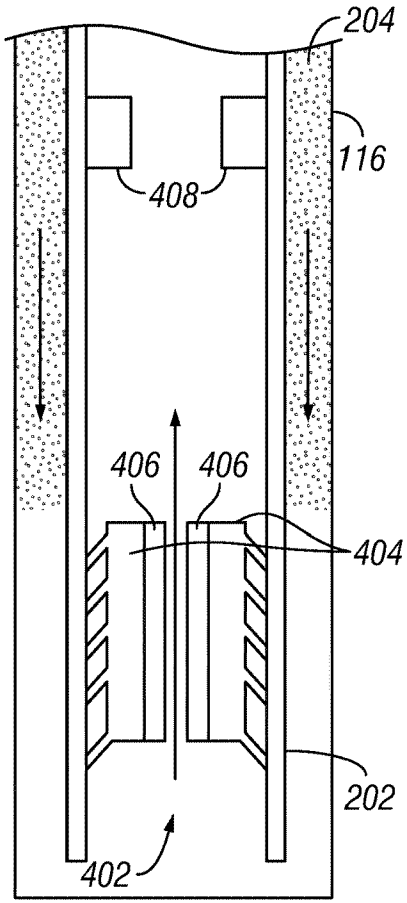

The wellbore 116 comprises a plug assembly 302, 402 that, in turn, comprises a plug 304, 404, as illustrated in FIG.'s 3A-3C and 4A-4D. The assembly 302, 402 is disposed within the casing 202 such that it is in slidable connection with the inside wall of the casing 202. Thus, for instance, as illustrated in FIG. 3A, the assembly is in contact with the inside casing wall and remains stationary. Alternatively, as illustrated in FIG.'s 4A-4D, the assembly while in contact with the casing wall is able to slide along the casing.

The plug assembly 302, 402 comprises a pH-sensitive material 306, 406 that is selectively reacting to the fluid having the pH 204. To illustrate, the fluid having a pH can be basic, and the pH-sensitive material reacts to basic but not acidic pH. Thus, in this illustration, downhole fluids having acidic pH and passing by or through the plug assembly would not result in a reaction with the pH-sensitive material. Conversely, in the inventive method, the fluid having the pH reacts with the pH-sensitive material, such that contact of the fluid with the material results in mobilization of the plug assembly through the casing, as illustrated in FIG.'s 3B and 4C. In this manner, the plug assembly traverses the casing 202 in the direction of flow of the fluid having the pH, wherein the plug assembly remains in substantial proximity to the leading edge of the fluid having the pH.

The wellbore casing further comprises at least one stationary constriction 308, 408 that is attached to the inside wall of the casing 202 opposite to the direction of flow of the fluid having the pH. That is to say, the relative position of the constriction is chosen such that it exists in front of the leading edge of the fluid having the pH, whether the fluid is displaced downhole or uphole.

In the inventive method, the plug assembly 302, 402, once mobilized, traverses the casing in the direction of flow of the fluid having the pH. The plug assembly contacts the constriction 308, 408, and such contact is detected, thereby indicating displacement and location of the fluid having the pH through the casing.

In one embodiment, the fluid having a pH is displaced downstream through the casing. Accordingly, the plug assembly is also displaced downstream. Hence, for instance, this embodiment of the inventive method is useful for detecting fluids that are injected downhole.

In another embodiment, as illustrated in FIG.'s 3A-3C and 4A-4D, the fluid having a pH 204 is displaced downstream through the annulus of the wellbore casing 202. The fluid 204 thus reaches the bottom of the casing, turns the corner, and is then displaced upward through the casing 202. Accordingly, a plug assembly 302, 402 in the casing 202 is then displaced upward and contacted with a constriction 308. To illustrate, a constriction placed at the bottom of the casing would allow for accurate detection of the fluid once it reaches the bottom of the casing annulus. This embodiment is especially useful in reverse cementing operations, where detecting of contact between the plug assembly and constriction signals to a surface operator when to shut down the reverse cementing operation.

Plug Assembly

Various configurations of the plug assembly are possible depending upon. the requirements of the operation at hand. In some embodiments, the plug assembly is configured for use wherein the fluid having a pH is injected downhole through the casing or, alternatively, down the casing annulus and then upward through the casing. In these embodiments, as illustrated by FIG.'s 4A-4D, the plug 402 can comprise at least one internal channel terminating at the downhole and uphole ends of the plug. The pH-sensitive material 404 is disposed partially within the channel, such that any fluid is allowed to pass through the channel. Various configurations of the pH-sensitive material are possible. For instance, the material 406 is coated substantially uniformly onto the inner surface of the channel, thereby forming a concentric channel. Alternatively, the material is a permeable matrix, such as a honeycomb structure, thereby allowing fluid to pass through a multitude of channels.

In these embodiments, the plug assembly comprises a slidable connection between the plug and inside wall of the casing. Various connections are possible, so long as the connection engenders a seal between the plug and the casing wall. For instance, as illustrated by FIG.'s 4A-4D, in some embodiments the connection is one or more rigid or semi-rigid ring seals. In other embodiments, the connection is a sleeve surrounding the plug.

Other embodiments of the plug assembly and plug are especially useful when the fluid having a pH is displaced downward through the annulus of the casing. For instance, the plug is a single or series of multiple plugs that are buoyant in the fluid having a pH. In this embodiment, as illustrated by FIG.'s 3A-3C, the plug 304 is held in place within the casing by the pH-sensitive material 306 at least at one point. Thus, the pH-sensitive material simultaneously anchors the plug in the casing and allows displacement of fluid around the plug. When the fluid having the pH 204 contacts the pH-sensitive material 306, the material loses its anchor to the casing 202, thereby allowing the buoyant plug 304 to move freely with the fluid until the plug 304 contacts with a constriction 308.

Fluid with pH and pH-sensitive Material

As generally described above, the choice of a pH-sensitive material is governed by its match with the fluid having a pH, such that the pair of material and fluid result in a reaction. In some embodiments, for example, the fluid has a pH of about 3 to about 6, i.e., it is acidic. Accordingly, the pH-sensitive material is one that that reacts with aqueous acid.

In other embodiments, the fluid has a pH of about 8 to about 13, i.e., it is basic. Examples of strongly basic fluids are cements. Hence, the pH-sensitive material is chosen as one that reacts selectively to basic aqueous media.

The reaction between the pH-sensitive material and fluid with a pH results in the plug or plug assembly being mobilized substantially on the front of the fluid as it is displaced through the casing. Depending upon the particular configuration of the plug assembly as described above, according to some embodiments, the reaction comprises the material undergoing one or more of shrinking, corrosion, dissolution, degradation, softening, and embrittlement. In other embodiments, the material undergoes one or more of hardening, swelling, and strengthening. For example, according to some embodiments, a pH-sensitive material disposed within a channel in the plug allows fluids to pass without reaction, but then contact with the fluid having a pH prompts reaction with the material such that it swells and thereby closes the channel to further fluid displacement, resulting the plug assembly to be pushed along the casing.

Exemplary materials for use in these embodiments include without limitation reversibly-swellable polymers having at least one acidic group, e.g., —COOH and —$SO_3H$, such as in polyacrylic acid. Contact of these materials with fluids having a basic pH, such as cements, prompt the material to swell.

In various embodiments employing a plug affixed to the casing wall by the pH-reactive material, contact of the material with the fluid having a pH results in the material shrinking, corroding, dissolving, degrading, softening, and/or becoming brittle. In this manner, the anchoring function of the material is disrupted, thereby freeing the plug to travel along the casing with the fluid.

In other embodiments, the pH-sensitive material comprises an acidic material in combination with a pre-swollen polymer having at least one basic group. For instance, the acidic material and pre-swollen polymer are admixed in a heterogeneous mixture. Alternatively, the acidic material forms a coating on the pre-swollen polymer. Contact of the pH-sensitive material with a basic fluid, such as a cement, neutralizes the acidic material, and then prompts shrinking of the pre-swollen polymer upon its exposure to the basic fluid. An illustrative pH-sensitive material useful for this purpose is chitosan that is packaged within a permeable acidic material.

In another embodiment, the pH-sensitive material is a polymeric that degrades when exposed to the fluid having a high pH, such as cements. Exemplary polymers in this context are bismaleimides, condensation polyimides, triazines, and blends thereof. The polymers degrade to form dissolved resins and loose fibers. Another example is poly lactic acid, which undergoes hydrolysis via cleavage of its ester groups when catalyzed by hydronium and hydroxide ions.

Reactions between the pH-sensitive material and fluid having a pH are further dependent upon temperature, concentration, and in some cases pressure. The present invention allows for adjustment of composition, design, and amounts of materials to accommodate variations in wellbore conditions in order to optimize the pairing of pH-sensitive material and fluid having a pH.

Constriction

Various designs and configurations of constriction in the casing are suitable for use in the inventive method. In some embodiments, a single constriction totally blocks the passage of the plug or plug assembly. In other embodiments, the constriction or series of constrictions allow passage of the plug with difficulty. Regardless of the particular choice of constriction design, contact between the plug and constriction results in impeded fluid flow that is easily detected by surface operators as a pressure spike.

In various embodiments, the constriction is a substantially annular barrier that is fixed to the inside wall of the casing. The barrier thus serves as a hard stop in embodiments wherein the plug or plug assembly is in slidable connection with the inside wall of the casing. Alternatively, the inside diameter of the annular barrier is chosen to be equal or less than the diameter of a plug, such as a buoyant plug. In this example, the plug passes through the annular barrier with difficulty; the plug and/or barrier are composed of materials that are capable of slightly deforming or compressing.

In other embodiments, the substantially annular barrier comprises one or more channels that allow displacement of fluids through the channels. For example, the inside diameter of the barrier is substantially less than the diameter of the plug, such that the barrier functions as a stop. Thus, a buoyant plug cannot pass the barrier, but its arrested displacement against the barrier is sufficient to impede fluid flow enough to generate a pressure spike in the fluid.

Some embodiments of the invention provide for a series of two or more constrictions. Thus, for instance, displacement of a plug through the series a series of substantially annular barriers would generate multiple pressure spikes. In some embodiments, the inside diameters of the barriers are equal. In this case, the pressure spikes have substantially the same amplitude. Yet in other embodiments, the inside diameters are different from each other, and can be ordered from least to greatest, greatest to least, or randomly. In this case, the observed pattern of pressure spike amplitudes correlates inversely to the diameters of the barriers. A series of barriers according to any of these embodiments is useful, for instance, in increasing confidence of an endpoint of an operation: the observation of a series of pressure spikes is more definitive than a single spike.

Detecting

The invention contemplates any means of communicating the contact between the plug or plug assembly and constriction. Various sensing and communication equipment known in the art is adapted for this purpose. In general, the detecting comprises active and/or passive measuring of one or more of electrical, magnetic, optical, pressure and pneumatic signals.

More specifically, according to some embodiments, the detecting comprises passive measuring. A convenient methodology in this context is the measurement of pressure signals by a surface operator. Thus, for instance, the pressure signal is a change in wellbore pressure coincident with contact of the plug assembly with a constriction in the wellbore casing. In this case, the change is an increase in pressure. In embodiments wherein the plug is displaced through a constriction, it is possible to observe sudden decreases in pressure that are coincident with the plug breaking contact with the constriction. All combinations of these changes are contemplated by the invention.

The downhole detection of the fluid having a pH is useful not only for monitoring the position of the fluid front, but also for signaling to a surface operator to take further action. For instance, in some embodiments, the detection prompts addition of one or more fluids to the fluid having a pH. Alternatively, an operator ceases the displacing of the fluid having a pH through the wellbore. This is important, for instance, in reverse cementing operations when an operator wishes to accurately detect completion of the cementing, i.e., when only the prescribed amount of cement has been placed.

System

In accordance with an embodiment, the invention provides a system that uses or that can be generated by use of an embodiment of the method described herein in a subterranean formation, or that can perform or be generated by performance of the method described herein.

In some embodiments, the system comprises a drillstring disposed in a wellbore, the drillstring including a drill bit at a downhole end of the drillstring. The system can also include an annulus between the drillstring and the wellbore. Further, in accordance with one embodiment, the system includes a pump configured to circulate fluid through the drill string, through the drill bit, and back above-surface through the annulus. In some embodiments, the system includes a fluid processing unit configured to process the fluid exiting the annulus to generate a cleaned drilling fluid for recirculation through the wellbore.

The pump is a high pressure pump in some embodiments. As used herein, the term "high pressure pump" refers to a pump that is capable of delivering a fluid to a subterranean formation (e.g., downhole) at a pressure of about 1000 psi or greater. A high pressure pump can be used when it is desired to introduce the fluid to a subterranean formation at or above a fracture gradient of the subterranean formation, but it can also be used in cases where fracturing is not desired. In some embodiments, the high pressure pump can be capable of fluidly conveying particulate matter, such as proppant particulates, into the subterranean formation. Suitable high pressure pumps are known to one having ordinary skill in the art and can include floating piston pumps and positive displacement pumps.

In other embodiments, the pump is a low pressure pump. As used herein, the term "low pressure pump" refers to a pump that operates at a pressure of about 1000 psi or less. In some embodiments, a low pressure pump can be fluidly coupled to a high pressure pump that is fluidly coupled to the tubular. That is, in such embodiments, the low pressure pump is configured to convey the fluid to the high pressure pump. In such embodiments, the low pressure pump can "step up" the pressure of the composition before it reaches the high pressure pump.

In some embodiments, the system described herein further includes a mixing tank that is upstream of the pump and in which the fluid is formulated. In various embodiments, the pump (e.g., a low pressure pump, a high pressure pump, or a combination thereof) conveys the composition from the mixing tank or other source of the composition to the tubular. In other embodiments, however, the composition e formulated offsite and transported to a worksite, in which case the composition is introduced to the tubular via the pump directly from its shipping container (e.g., a truck, a railcar, a barge, or the like) or from a transport pipeline. In either case, the composition is drawn into the pump, elevated to an appropriate pressure, and then introduced into the tubular for delivery to the subterranean formation.

With reference to FIG. 1, the fluid directly or indirectly affects one or more components or pieces of equipment associated with a wellbore drilling assembly 100, according to one or more embodiments. While FIG. 1 generally depicts a land-based drilling assembly, those skilled in the art will readily recognize that the principles described herein are equally applicable to subsea drilling operations that employ floating or sea-based platforms and rigs, without departing from the scope of the disclosure.

As illustrated, the drilling assembly 100 can include a drilling platform 102 that supports a derrick 104 having a traveling block 106 for raising and lowering a drill string 108. The drill string 108 may include, but is not limited to, drill pipe and coiled tubing, as generally known to those skilled in the art. A kelly 110 supports the drill string 108 as it is lowered through a rotary table 112. A drill bit 114 is attached to the distal end of the drill string 108 and is driven either by a downhole motor and/or via rotation of the drill string 108 from the well surface. As the bit 114 rotates, it creates a wellbore 116 that penetrates various subterranean formations 118.

A pump 120 (e.g., a mud pump) circulates drilling fluid 122 through a feed pipe 124 and to the kelly 110, which conveys the drilling fluid 122 downhole through the interior of the drill string 108 and through one or more orifices in the drill bit 114. The drilling fluid 122 is then circulated back to the surface via an annulus 126 defined between the drill string 108 and the walls of the wellbore 116. At the surface, the recirculated or spent drilling fluid 122 exits the annulus 126 and may be conveyed to one or more fluid processing unit(s) 128 via an interconnecting flow line 130. After passing through the fluid processing unit(s) 128, a "cleaned" drilling fluid 122 is deposited into a nearby retention pit 132 (e.g., a mud pit). While illustrated as being arranged at the outlet of the wellbore 116 via the annulus 126, those skilled in the art will readily appreciate that the fluid processing unit(s) 128 may be arranged at any other location in the drilling assembly 100 to facilitate its proper function, without departing from the scope of the disclosure.

The fluid may be added to, among other things, a drilling fluid 122 via a mixing hopper 134 communicably coupled to or otherwise in fluid communication with the retention pit 132. The mixing hopper 134 may include, but is not limited to, mixers and related mixing equipment known to those skilled in the art. In other embodiments, however, the fluid is added to, among other things, a drilling fluid 122 at any other location in the drilling assembly 100. In at least one embodiment, for example, there is more than one retention pit 132, such as multiple retention pits 132 in series. Moreover, the retention pit 132 can represent one or more fluid storage facilities and/or units where the composition may be stored, reconditioned, and/or regulated until added to a drilling fluid 122.

As mentioned above, the fluid may directly or indirectly affect the components and equipment of the drilling assembly 100. For example, the fluid may directly or indirectly affect the fluid processing unit(s) 128, which may include, but is not limited to, one or more of a shaker (e.g., shale shaker), a centrifuge, a hydrocyclone, a separator (including magnetic and electrical separators), a desilter, a desander, a separator, a filter (e.g., diatomaceous earth filters), a heat exchanger, or any fluid reclamation equipment. The fluid processing unit(s) 128 may further include one or more sensors, gauges, pumps, compressors, and the like used to store, monitor, regulate, and/or recondition the composition.

The fluid may directly or indirectly affect the pump 120, which is intended to represent one or more of any conduits, pipelines, trucks, tubulars, and/or pipes used to fluidically convey the fluid downhole, any pumps, compressors, or motors (e.g., topside or downhole) used to drive the composition into motion, any valves or related joints used to regulate the pressure or flow rate of the composition, and any sensors (e.g., pressure, temperature, flow rate, and the like), gauges, and/or combinations thereof, and the like. The fluid may also directly or indirectly affect the mixing hopper 134 and the retention pit 132 and their assorted variations.

The fluid can also directly or indirectly affect various downhole equipment and tools that comes into contact with the fluid such as, but not limited to, the drill string 108, any floats, drill collars, mud motors, downhole motors, and/or pumps associated with the drill string 108, and any measurement while drilling (MWD)/logging while drilling (LWD) tools and related telemetry equipment, sensors, or distributed sensors associated with the drill string 108. The fluid may also directly or indirectly affect any downhole heat exchangers, valves and corresponding actuation devices, tool seals, packers and other wellbore isolation devices or components, and the like associated with the wellbore 116.

While not specifically illustrated herein, the fluid may also directly or indirectly affect any transport or delivery equipment used to convey the composition to the drilling assembly 100 such as, for example, any transport vessels, conduits, pipelines, trucks, tubulars, and/or pipes used to fluidically move the composition from one location to another, any pumps, compressors, or motors used to drive the composition into motion, any valves or related joints used to regulate the pressure or flow rate of the fluid, and any sensors (e.g., pressure and temperature), gauges, and/or combinations thereof, and the like.

Figure 2:
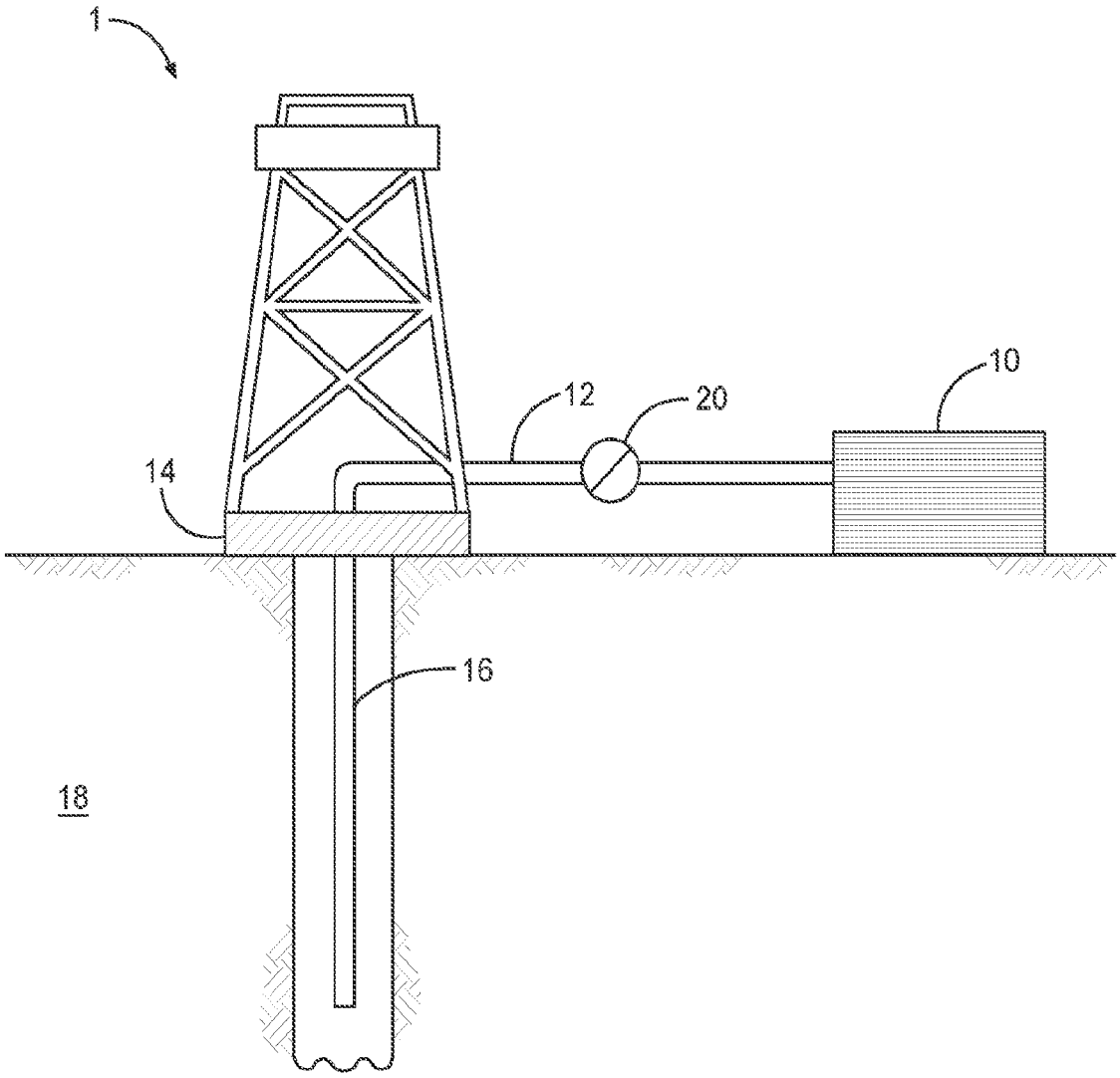
FIG. 2 illustrates a system for delivering a composition to a subterranean formation in accordance with various embodiments.

FIG. 2 shows an illustrative schematic of systems that can deliver the fluid of the present invention to a subterranean location, according to one or more embodiments. It should be noted that while FIG. 2 generally depicts a land-based system or apparatus, like systems and apparatuses can be operated in subsea locations as well. Embodiments of the present invention can have a different scale than that depicted in FIG. 2. As depicted in FIG. 2, system or apparatus 1 can include mixing tank 10, in which an embodiment of the fluid can be formulated. The fluid can be conveyed via line 12 to wellhead 14, where the composition enters tubular 16, with tubular 16 extending from wellhead 14 into subterranean formation 18. Upon being ejected from tubular 16, the fluid can subsequently penetrate into subterranean formation 18. Pump 20 can be configured to raise the pressure of the fluid to a desired degree before its introduction into tubular 16. It is to be recognized that system or apparatus 1 is merely exemplary in nature and various additional components can be present that have not necessarily been depicted in FIG. 2 in the interest of clarity. In some examples, additional components that can be present include supply hoppers, valves, condensers, adapters, joints, gauges, sensors, compressors, pressure controllers, pressure sensors, flow rate controllers, flow rate sensors, temperature sensors, and the like.

Although not depicted in FIG. 2, at least part of the fluid can, in some embodiments, flow back to wellhead 14 and exit subterranean formation 18. The fluid that flows back can be substantially diminished in the concentration of various components therein. In some embodiments, the fluid that has flowed back to wellhead 14 can subsequently be recovered, and in some examples reformulated, and recirculated to subterranean formation 18.

The fluid of the invention can also directly or indirectly affect the various downhole or subterranean equipment and tools that can come into contact with the composition during operation. Such equipment and tools can include wellbore casing, wellbore liner, completion string, insert strings, drill string, coiled tubing, slickline, wireline, drill pipe, drill collars, mud motors, downhole motors and/or pumps, surface-mounted motors and/or pumps, centralizers, turbolizers, scratchers, floats (e.g., shoes, collars, valves, and the like), logging tools and related telemetry equipment, actuators (e.g., electromechanical devices, hydromechanical devices, and the like), sliding sleeves, production sleeves, plugs, screens, filters, flow control devices (e.g., inflow control devices, autonomous inflow control devices, outflow control devices, and the like), couplings (e.g., electro-hydraulic wet connect, dry connect, inductive coupler, and the like), control lines (e.g., electrical, fiber optic, hydraulic, and the like), surveillance lines, drill bits and reamers, sensors or distributed sensors, downhole heat exchangers, valves and corresponding actuation devices, tool seals, packers, cement plugs, bridge plugs, and other wellbore isolation devices or components, and the like. Any of these components can be included in the systems and apparatuses generally described above and depicted in FIG. 2.

Additional Embodiments

The invention contemplates numerous embodiments, including those described hereinabove and those below. The numbering of the following embodiments is not to be construed as designating levels of importance.

In embodiment 1, the invention provides a method for treating a subterranean formation, comprising:

a. displacing a fluid having a pH through a wellbore in the subterranean formation, the wellbore having a casing, wherein:

i. the casing comprises at least one plug assembly comprising a plug, wherein the plug assembly is in slidable connection to the inside wall of the casing, wherein the plug assembly is stationary in the absence of the fluid having the pH;

and wherein the plug assembly comprises a pH-sensitive material that is selectively reactive to the fluid having the pH, such that contact of the material with the fluid mobilizes the plug assembly through the casing; and ii. at least one stationary constriction attached to the inside casing wall on the side of the plug assembly opposite to the direction of flow of the fluid having the pH;

b. displacing the plug assembly through the casing in the direction of flow of the fluid having the pH whereby the plug assembly remains in substantial proximity to the leading edge of the fluid having the pH; and c. detecting contact of the plug assembly with at least one constriction, thereby indicating displacement of the fluid having the pH through the casing.

Embodiment 2 relates to embodiment 1, wherein the fluid having the pH and the plug assembly are both displaced downstream through the casing.

Embodiment 3 relates to embodiment 1, wherein the fluid having the pH is displaced downstream through the annulus of the wellbore, and wherein the plug assembly is displaced upward through the casing.

Embodiment 4 relates to embodiment 1, wherein the fluid has a pH of about 3 to about 6 or a pH of about 8 to about 13.

Embodiment 5 relates to embodiment 4, wherein the fluid has a pH of about 8 to about 13.

Embodiment 6 relates to embodiment 3, wherein the fluid is a cement.

Embodiment 7 relates to embodiment 4, wherein the fluid has a pH of about 3 to about 6.

Embodiment 8 relates to any one of embodiments 1, 2, 4, 6, and 7, wherein the plug is a buoyant plug and the pH-sensitive material is disposed between the plug and at least one point on the inside wall of the casing.

Embodiment 9 relates to embodiment 8, wherein the buoyant plug is a foam ball.

Embodiment 10 relates to any one of embodiments 1-8, wherein the constriction is a substantially annular barrier, the outside of which barrier is fixed to the inside wall of the casing, and wherein an inside diameter of the substantially annular barrier is equal to or less than the diameter of the plug.

Embodiment 11 relates to embodiment 10, wherein the inside diameter of the barrier is less than the diameter of the plug.

Embodiment 12 relates to embodiment 11, wherein barrier contact with the plug does not allow displacement of the plug past the barrier.

Embodiment 13 relates to any one of embodiments 10-12, wherein the barrier comprises one or more channels allowing displacement of fluids through the channels.

Embodiment 14 relates to any one of embodiments 1-11, wherein the casing comprises a series of two or more constrictions.

Embodiment 15 relates to embodiment 14, wherein each constriction in the series is a substantially annular barrier, the outside of which barrier is fixed to the inside wall of the casing, and wherein an inside diameter of the substantially annular barrier is equal to or less than the diameter of the plug, and wherein the inside diameter of each barrier is independently selected to be equal to or less than the diameter of the plug.

Embodiment 16 relates to embodiment 15, wherein the inside diameters of the barriers are equal.

Embodiment 17 relates to embodiment 15, wherein the inside diameters the barriers are different from each other.

Embodiment 18 relates to embodiment 17, wherein the inside diameters of the barriers decrease in succession from lowermost to uppermost.

Embodiment 19 relates to embodiment 17, wherein the inside diameters of barriers increase in succession from lowermost to uppermost.

Embodiment 20 relates to embodiment 1, wherein the plug comprises at least one internal channel terminating at the downhole and uphole ends of the plug, and wherein the pH-sensitive material is disposed partially within the channel, whereby fluid is allowed to pass through the channel.

Embodiment 21 relates to embodiment 20, wherein the pH-sensitive material is coated substantially uniformly upon the wall of the internal channel.

Embodiment 22 relates to embodiment 20 or 21, wherein the slidable connection comprises one or more seals disposed between, and in simultaneous contact with, the plug and inside casing wall.

Embodiment 23 relates to any one of embodiments 20-22, wherein the constriction prevents further displacement of the plug.

Embodiment 24 relates to any one of embodiments 1-23, wherein the pH-sensitive material undergoes one or more of shrinking, corrosion, dissolution, degradation, softening, and embrittlement when the fluid having a pH contacts the pH-sensitive material.

Embodiment 25 relates to embodiment 24, wherein the pH-sensitive material comprises a reversibly-swellable polymer having at least one acidic group.

Embodiment 26 relates to embodiment 24, wherein the pH-sensitive material comprises an acidic material in combination with a pre-swollen polymer having at least one basic group.

Embodiment 27 relates to embodiment 26, wherein the acidic material is present as a coating on the pre-swollen polymer.

Embodiment 28 relates to any one of embodiments 20-23, wherein the pH-sensitive material undergoes one or more of hardening, swelling, and strengthening.

Embodiment 29 relates to embodiment 28, wherein the pH-sensitive material comprises a reversibly-swellable polymer having at least one acidic group.

Embodiment 30 relates to any one of embodiments 1-29, wherein the detecting comprises active and/or passive measuring of one or more of electrical, magnetic, optical, pressure and pneumatic signals.

Embodiment 31 relates to embodiment 30, wherein the detecting comprises passive measuring.

Embodiment 32 relates to embodiment 31, wherein the signal is a pressure signal.

Embodiment 33 relates to embodiment 32, wherein the pressure signal is a change in wellbore pressure coincident with contact of the plug assembly with a constriction in the wellbore casing.

Embodiment 34 relates to embodiment 33, wherein the change is an increase in pressure.

Embodiment 35 relates to any one of embodiments 1-34, further comprising:

d. ceasing the displacing of fluid having a pH through the wellbore after the detecting of contact of the plug assembly with at least one constriction.

Embodiment 36 relates to any one of embodiments 1-35, wherein the fluid having a pH is displaced by a pump.

Embodiment 37 is a system comprising:

i. at least one plug assembly comprising a plug, wherein the plug assembly is in slidable connection to the inside wall of a wellbore casing, and
   wherein the plug assembly comprises a selectively pH-sensitive material; and
ii. at least one stationary constriction attached to the inside wall of the casing.

We claim:

1. A method for treating a subterranean formation, comprising:

a. displacing a fluid having a pH through a wellbore in the subterranean formation, the wellbore having a casing, wherein:
   i. the casing comprises at least one plug assembly comprising a plug and a pH-sensitive material attached to the plug, wherein the plug assembly is in slidable connection to the inside wall of the casing, wherein the plug assembly is stationary in the absence of the fluid having the pH;
      and
      wherein the pH-sensitive material is selectively reactive to the fluid having the pH, such that contact of the material with the fluid mobilizes the plug assembly through the casing; and
   ii. at least one stationary constriction attached to the inside casing wall on the side of the plug assembly opposite to the direction of flow of the fluid having the pH;
b. displacing the plug assembly through the casing in the direction of flow of the fluid having the pH, whereby the plug assembly remains in substantial proximity to the leading edge of the fluid having the pH; and
c. detecting contact of the plug assembly with at least one constriction, thereby indicating displacement of the fluid having the pH through the casing.

2. The method according to claim 1, wherein the fluid having the pH and the plug assembly are both displaced downstream through the casing.

3. The method according to claim 1, wherein the fluid having the pH is displaced downstream through the annulus of the wellbore, and wherein the plug assembly is displaced upward through the casing.

4. The method according to claim 1, wherein the fluid has a pH of about 3 to about 6 or a pH of about 8 to about 13.

5. The method according to, claim 1, wherein the plug is a buoyant plug and the pH-sensitive material is disposed between the plug and at least one point on the inside wall of the casing.

6. The method according to claim 1, wherein the constriction is a substantially annular barrier, the outside of which barrier is fixed to the inside wall of the casing, and wherein an inside diameter of the substantially annular barrier is equal to or less than the diameter of the plug.

7. The method according to claim 1, wherein the casing comprises a series of two or more constrictions.

8. The method according to claim 1, wherein the plug comprises at least one internal channel terminating at the downhole and uphole ends of the plug, and wherein the pH-sensitive material is disposed partially within the channel, whereby fluid is allowed to pass through the channel.

9. The method according to claim 1, wherein the pH-sensitive material undergoes one or more of shrinking, corrosion, dissolution, degradation, softening, and embrittlement when the fluid having a pH contacts the pH-sensitive material.

10. The method according to claim 1, wherein the detecting comprises active and/or passive measuring of one or more of electrical, magnetic, optical, pressure and pneumatic signals.

11. The method according to claim 1, further comprising:

d. ceasing the displacing of fluid having a pH through the wellbore after the detecting of contact of the plug assembly with at least one constriction.

12. A system comprising:

i. at least one plug assembly comprising a plug and a selectively pH-sensitive material attached to the plug, wherein the plug assembly is in slidable connection to the inside wall of a wellbore casing;

and ii. at least one stationary constriction attached to the inside wall of the casing.

13. The system of claim 12, wherein the pH-sensitive material is selectively reactive to a fluid having a pH, such that contact of the material with the fluid mobilizes the plug assembly through the casing and wherein the plug assembly is stationary within the casing in the absence of the fluid having the pH.

14. The system of claim 12, comprising a passive pressure sensor positioned to detect contact of the plug assembly with the at least one stationary constriction, thereby indicating displacement of the fluid having the pH through the wellbore casing.

* * * * *